United States Patent [19]

Orr

[11] 4,119,817

[45] Oct. 10, 1978

[54] BREAKER POINT ASSEMBLY

[76] Inventor: William J. Orr, 5909 Berkeley Dr., Berkeley, Mo. 63134

[21] Appl. No.: 720,758

[22] Filed: Sep. 7, 1976

[51] Int. Cl.[2] ..... H01H 19/00

[52] U.S. Cl. ..... 200/19 A; 200/30 A; 200/31 A; 200/DIG. 42

[58] Field of Search ..... 200/19 R, 19 A, 30 A, 200/31 A, 30 AA, DIG. 42, 240, 241, 242

[56] References Cited

U.S. PATENT DOCUMENTS

| | | | |
|---|---|---|---|
| 1,708,225 | 4/1929 | Kroeger | 200/19 A |
| 2,519,976 | 8/1950 | Phelon | 200/30 AA |
| 3,249,730 | 5/1966 | Felson | 200/19 A X |
| 3,317,808 | 5/1967 | Yott | 318/346 |
| 3,604,864 | 9/1971 | Habert | 200/19 A |
| 3,702,384 | 11/1972 | Garza | 200/19 A |
| 3,757,061 | 9/1973 | Clemett, Jr. | 200/19 |

FOREIGN PATENT DOCUMENTS

| | | | |
|---|---|---|---|
| 1,314,223 | 11/1962 | France | 200/19 A |

*Primary Examiner*—James R. Scott

[57] ABSTRACT

The present invention relates to an improved breaker point assembly for use with automobile internal combustion engines and the like comprising an improved cam assembly for moving a breaker arm assembly to provide more efficient contact engagement by preventing contact pitting and welding of the contacts together. The breaker arm assembly is pivotally mounted to a tapered post to allow upward movement of the breaker arm. Spring biasing means restrains movement of the breaker arm and the force of the spring biasing means is overcome by the resultant force due to cam, cam follower engagement, such force being greater than the downward force applied by the spring biasing means to the contact breaker arm.

6 Claims, 5 Drawing Figures

BREAKER POINT ASSEMBLY

BACKGROUND OF THE INVENTION

Conventional breaker point assemblies in use in conjunction with automobile internal combustion engines include means for cyclically opening and closing contact points with the distributor to allow electrical energy to be cyclically fed to the spark plugs. Generally these points consist of cylindrical metallic points with flattened opposite ends. One flat surface of one cylindrical point is attached to a breaker arm and a flat surface of the other point is attached to a projection on the assembly base.

During operation the free flat surfaces are cyclically brought into contact with each other as a result of travel of the first cylinder back and forth essentially along its longitudinal axis, such motion being caused by the breaker arm being operably coupled to a cam follower which follows surfaces on what will be referred to as the conventional cam. A problem which has arisen as a result of this configuration which has resulted in reduced engine efficiency, reduced gas mileage and ultimately engine failure is the pitting and coating which accumulates on the free flat ends of the points after continued use. At times the points become welded together.

SUMMARY OF THE INVENTION

It is therefore an object of the present invention to provide a device which allows minor modification of the conventional point assembly wherein one point is moved longitudinally, to allow addition of means to also cause transverse movement of the point while the points are in contact causing any pitting and coating which may have previously accumulated to be eliminated or substantially reduced.

A further object of the present invention is to provide such a device which is simply and economically manufactured and used.

These together with other objects and advantages which will become subsequently apparent, reside in the details and construction and operation as more fully hereinafter described and claimed, reference being had to the accompanying drawings forming a part hereof, wherein like numerals refer to like parts throughout, and in which;

DETAILED DESCRIPTION OF THE INVENTION

Figure 1:
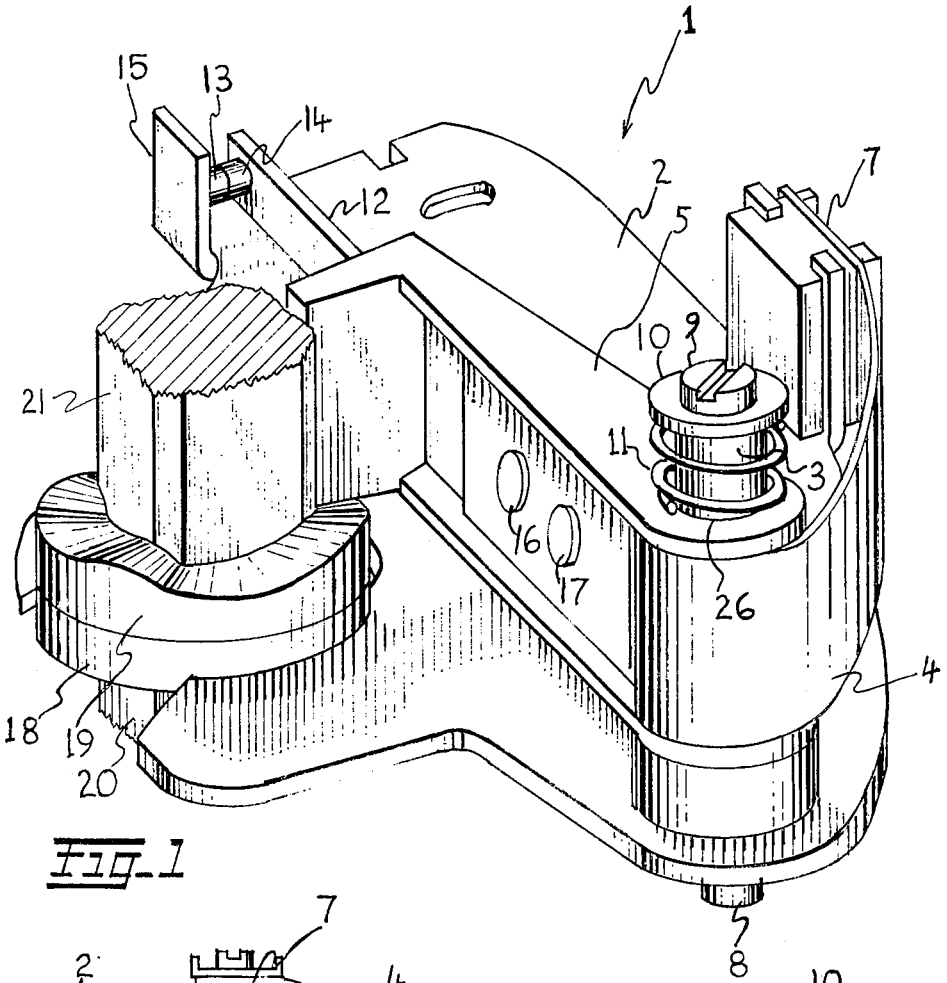
FIG. 1 is a perspective view of a breaker point assembly constructed in accordance with and embodying the present invention.

Referring now in more detail and by reference characters to the drawings which illustrate practical embodiments of the present invention, FIG. 1 is a perspective view of breaker point assembly device 1, constructed in accordance with, used in and embodying the present invention.

As shown in FIG. 1, device 1, comprises base plate 2, upon which is mounted pivot post 3, about which breaker point arm 5, pivots tension spring 4, and breaker point arm 5, to which it is attached by fasteners 16, and, 17, cam follower 6, mounted on arm 5, or integral therewith, connector block 7, which provides the electrical connection point between tension spring 4, and the external ignition system (not shown) pivot pin 8, which is provided as an alignment projection to mount device 1, in a conventional distributor screw 9, which adjusts the position of washer 10, and thereby the compression force on spring 11, breaker point arm extension 12, points 13, and, 14, flange 15, cam bearing block 18, and barrel cam 19.

In typical operation, without the improvement contemplated herein, cam bearing block 18, and barrel cam 19, would be deleted, as would spring 11, and the functional events would essentially consist of the distributor cam post 20, being rotated by means not shown causing distributor cam 21, to be rotated. Cam follower 6, is held against cam 21, by the tension from spring 4, and as cam 21, rotates, cam follower 6, tracks the surface of cam 21, causing breaker point arm 5, and extension 12, to cyclically move away and towards the longitudinal axis of cam 21, causing point 14, to move away from and against point 13.

Electrically, device 1, functions such that current or voltage from the external ignition system is connected electrically to spring 4, a conductor, and from spring 4, to extension arm 12, a conductor which is attached to arm 5, and spring 4, by electrically conductive fasteners 16, and, 17. Electrical contact is extended from extension 12, to point 14, and from point 14, to point 14, to point 13, when they are in contact with each other.

Figure 2:
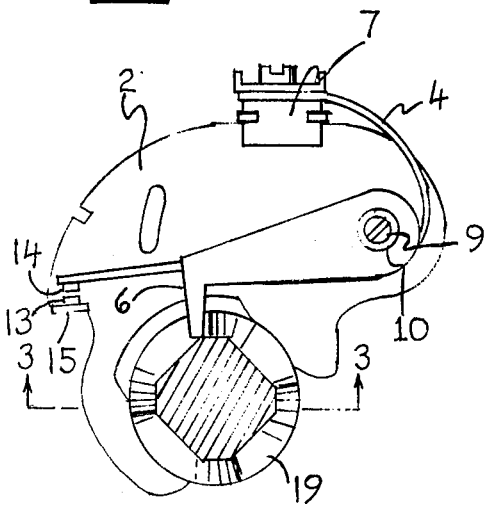
FIG. 2 is a partial sectional view of an embodiment to that shown in FIG. 1.
Figure 3:
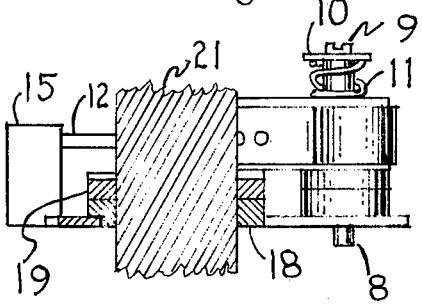
FIG. 3 is a partial sectional view of an embodiment to that shown in FIG. 1.
Figure 5:
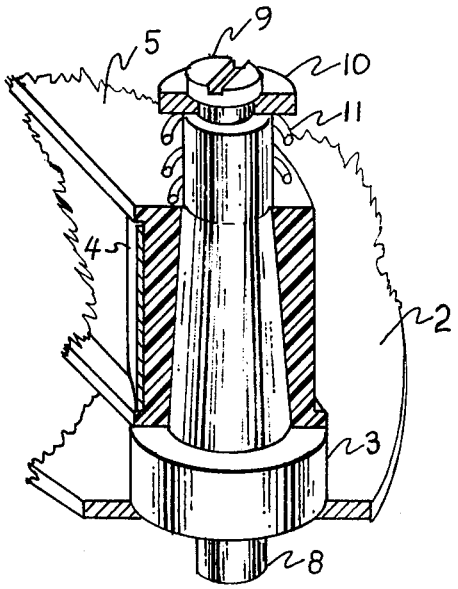
FIG. 5 is a partial sectional view of the device shown in FIG. 1.

Greater detail of the device 1, is shown in the partial sectional views shown in FIG. 2 and FIG. 3. As shown in FIGS. 1, 2, and 3, barrel cam 19, and bearing block 18, have been added thus causing cam follower 6, and point 14, to move away from and towards the longitudinal axis of cam 21, and also to cause cam follower 6, and point 14, to move up and down or parallel to its longitudinal axis in slidable contact with point 13. As follower 6, is caused to move up by cam 19, breaker arm 5, rises causing spring 11, to be compressed. Spring 11, disposed between washer 10, and arm 5, normally holds down arm 5. Post 3, is slightly tapered, i.e., the upper diameter is less than the lower diameter allowing free movement of arm 5, upwardly except as restrained by spring 11. FIG. 5 illustrates this feature of the device. The hole 26, provided in arm 5, is tapered to conform to post 3. FIG. 1, FIG. 2 and FIG. 3 illustrate that in the normal mode of operation of device 1, as cam 21, rotates, at such time as the vertical surface is in contact with a corner of cam 21, follower 6, is in contact with a valley on cam 19. As follower 6, contacts a wide surface on cam 21, follower 6, moves towards the longitudinal axis of cam 21, and point 14, moves into contact with point 13, and as this occurs, the lower edge of follower 6, starts up a hill on cam 19, causing point 14, to move upward in slidable contact with point 13, and while point 14, is still in contact with point 13, the lower edge of follower 6, goes down the hill on cam 19, causing point 14, to move downward in slidable contact with point 13.

Figure 4:
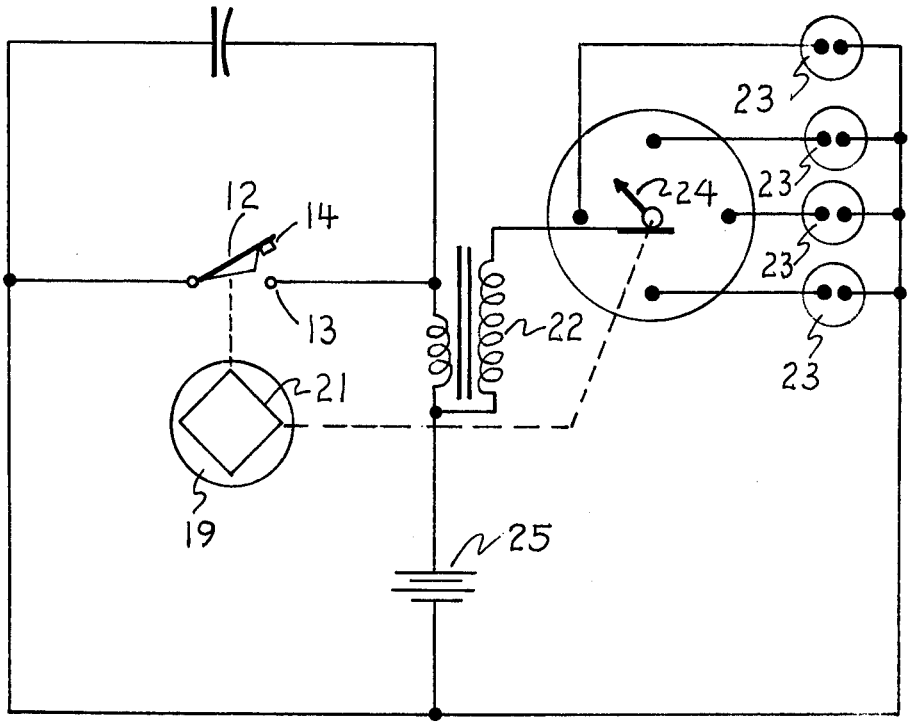
FIG. 4 is a circuit diagram illustrating the application of the device in FIG. 1.

It appears clear that cam follower 6, may be constructed into two separate followers or integral as shown as may cams 21, and, 19, be constructed integrally or separate as shown and cam 19, may be above cam 21, as well as below as shown. As shown in FIG. 4, the electrical circuit which contains the relevant elements is shown as well as their relationships to each other. As shown in FIG. 4, cam 21, is shown rotating causing arm 12, to move causing points 14, and, 13, to cyclically contact each other allowing current to pass through the ignition coil 22, when the points are closed and cyclical distribution of electrical energy to the spark plugs 23, via distributor rotor 24, from battery 25.

It should be understood that changes and modifications in the form, construction, arrangement, and combination of the breaker point assembly device and methods of making and using the same may be made and substituted for those herein shown and described without departing from the nature and principle of my invention.

I claim:

1. A breaker point assembly for use with conventional internal combustion engines, comprising, base means, breaker arm means pivotally mounted on a post operably mounted on said base means, a fixed ignition point operably mounted on said base means, a second ignition point mounted on said breaker arm means and disposed such that as said breaker arm pivots in opposite directions the second point moves into contact with the first ignition point and then away from said first ignition point, first cam means operably mounted on a shaft and disposed proximate said base means, said first cam means disposed such that the longitudinal axis of the first cam shaft and its cam surfaces are essentially parallel to the longitudinal axis of said breaker arm post, second cam means operably mounted on said first cam shaft and disposed such that its cam surfaces are essentially transverse to the longitudinal axis of said cam shaft, first cam follower means operably mounted on said breaker arm means and disposed in contact with the cam surface of said first cam means, second cam follower means operably mounted on said breaker arm means and disposed in contact with the cam surface of said second cam means, first spring means operably mounted on said breaker arm means and said base means are disposed such that it causes said breaker arm means to pivot towards said first cam means, second spring means operably mounted on said breaker arm post and disposed between said breaker arm means and the end of said post distal from said base means.

2. A breaker point assembly for use with conventional internal combustion engines as described in claim 1 wherein said first and second cam means are integrally formed.

3. A breaker point assembly for use with conventional internal combustion engines as described in claim 1, wherein said first and second cam follower means are integrally formed.

4. A breaker arm post assembly for use in a conventional breaker point assembly which is provided with base means comprising, a tapered post, said post provided with longitudinal screw means operably mounted in one end thereof, said post operably mounted on said base means, spring retaining means operably mounted on said screw means, a breaker arm operably mounted on said post, spring means operably mounted on said post and disposed between said spring retaining means and said breaker arm.

5. A breaker point assembly as described in claim 1 wherein said post is tapered.

6. A breaker point assembly as described in claim 1 wherein said second cam means consists of a barrel cam.

* * * * *